US007774870B2

(12) United States Patent
Griffin et al.

(10) Patent No.: US 7,774,870 B2
(45) Date of Patent: Aug. 17, 2010

(54) ELONGATED SUCTION OUTLET ASSEMBLY WITH INTRINSICALLY SAFE SUMP

(75) Inventors: Ronald H. Griffin, Boonville, NC (US); Robert Rung, Hopatcong, NJ (US)

(73) Assignee: Hayward Industries, Inc., Elizabeth, NJ (US)

( * ) Notice: Subject to any disclaimer, the term of this patent is extended or adjusted under 35 U.S.C. 154(b) by 911 days.

(21) Appl. No.: 11/520,499

(22) Filed: Sep. 13, 2006

(65) Prior Publication Data

US 2007/0180605 A1 Aug. 9, 2007

Related U.S. Application Data

(60) Provisional application No. 60/716,549, filed on Sep. 13, 2005.

(51) Int. Cl.
*E04H 4/00* (2006.01)

(52) U.S. Cl. ..... 4/507

(58) Field of Classification Search ..... 4/507–512
See application file for complete search history.

(56) References Cited

U.S. PATENT DOCUMENTS

| | | | |
|---|---|---|---|
| 2,701,027 | A | 1/1955 | Scoville |
| D191,184 | S | 8/1961 | Scholz |
| 3,940,807 | A | 3/1976 | Baker et al. |
| 4,276,163 | A | 6/1981 | Gordon |
| 4,402,094 | A | 9/1983 | Sanders |
| D290,166 | S | 6/1987 | Jacuzzi |
| D299,522 | S | 1/1989 | Chalberg |
| D300,558 | S | 4/1989 | Warnekros |
| D319,295 | S | 8/1991 | Ohaus |
| D344,325 | S | 2/1994 | Chalberg |
| D363,768 | S | 10/1995 | Morgan |
| D377,389 | S | 1/1997 | Phillips et al. |
| 5,734,999 | A | 4/1998 | Nicholas |
| 5,978,981 | A | 11/1999 | Nelson |
| 6,088,842 | A | 7/2000 | Barnett |
| 6,170,095 | B1 | 1/2001 | Zars |
| 6,341,387 | B1 | 1/2002 | Zars |

(Continued)

OTHER PUBLICATIONS

U.S. Appl. No. 29/327,789, entitled: "Circular Suction Outlet Assembly Cover Design," filed on Nov. 13, 2008 (6 pages).

(Continued)

*Primary Examiner*—Tuan N Nguyen
(74) *Attorney, Agent, or Firm*—McCarter & English, LLP

(57) ABSTRACT

An elongated suction outlet assembly is provided for use in swimming pools, hot tubs and the like. The suction outlet assembly includes an elongated sump having at least one longitudinal, raised island extending upwardly from inside the sump, and an elongated cover engaging the sump. Safety features of the suction outlet assembly are designed to inhibit human entrapment and thereby reduce the related risk of serious injury or death. The cover is long enough to prevent a bather's body from covering and blocking all of the openings therein, and thereby avoids the creation of a dangerous entrapping force. In the event the cover becomes separated from the sump, the raised island(s) provides a back-up safety feature by preventing a bather's access to the suction outlet nozzle via narrow axial flow channels, thereby virtually eliminating the risk of limb entrapment.

18 Claims, 5 Drawing Sheets

U.S. PATENT DOCUMENTS

| | | | |
|---|---|---|---|
| 6,374,854 | B1 | 4/2002 | Acosta |
| 6,393,631 | B2 | 5/2002 | Schroader |
| 6,397,408 | B1 | 6/2002 | Veloskey et al. |
| 6,453,482 | B1 | 9/2002 | Mullings |
| D466,198 | S | 11/2002 | Mullings |
| 6,637,464 | B1 | 10/2003 | Cornwall |
| D485,889 | S | 1/2004 | DuBois |
| 6,738,994 | B2 | 5/2004 | Barnett et al. |
| 6,817,043 | B2 | 11/2004 | Zars |
| D581,723 | S | 12/2008 | Pan |
| 2004/0139541 | A1 | 7/2004 | Barnett |
| 2007/0180604 | A1 | 8/2007 | Griffin et al. |

OTHER PUBLICATIONS

U.S. Appl. No. 11/520,399, entitled "Circular Suction Outlet Assembly and Cover", (filed Sep. 13, 2006), Inventors: Ronald H. Griffin, et al.

Ex Parte Quayle Action dated Jun. 11, 2009 from CIP U.S. Appl. No. 29/327,789, filed Nov. 13, 2008, which claims priority from parent U.S. Appl. No. No. 11/520,399, filed Sep. 13, 2006 (10 pages).

ELONGATED SUCTION OUTLET ASSEMBLY WITH INTRINSICALLY SAFE SUMP

CROSS REFERENCE TO RELATED APPLICATION

This application claims priority of U.S. Provisional Patent Application Ser. No. 60/716,549, filed Sep. 13, 2005, the disclosure of which is incorporated by reference herein in its entirety.

FIELD OF THE INVENTION

The present invention relates to suction outlets for swimming pools and, more particularly, to suction outlets having safety features to inhibit human entrapment.

The term "suction outlets" shall indicate a fitting, fitting assembly, cover/grate, and related devices that provide a localized low pressure area for the transfer of water from a swimming pool, wading pool, spa, or hot tub.

BACKGROUND OF THE INVENTION

Various types of suction outlet assemblies have been developed in the past for use in swimming pools, each designed to inhibit human entrapment and thereby reduce the related risk of serious injury or death. One type of suction outlet assembly provides a cover having a larger surface area, so as to prevent a bather's body from covering the suction outlet and creating the large suction force that causes entrapment (see, for instance, U.S. Pat. Nos. 3,940,807, 5,734,999 and 6,170,095). However, should the cover become displaced from its associated suction outlet, or sump, any such safety features are obviated. Furthermore, such assemblies are often not conducive to widespread placement in swimming pools, given their unconventional structure and intrusive shape. In such circumstances, there is a need for a suction outlet assembly that includes safety features for both the cover and the underlying sump, and that can be introduced into swimming pools of conventional design.

SUMMARY OF THE INVENTION

The present invention overcomes the disadvantages and shortcomings discussed above by providing an elongated suction outlet, or sump, and cover therefore. More particularly, the device includes a sump having an elongated, trough-like body. The sump body has an outer wall with opposed ends, a bottom extending between the opposed ends, an open top opposite the bottom, and at least one island extending upwardly from the bottom. The island(s) is spaced from the outer wall so as to form a first axial flow channel on one side of the sump and a second axial flow channel on an opposite side of the sump. Each of the first and second axial flow channels has a width selected so as to inhibit the insertion of human body parts therein. An elongated cover is also provided that removably attaches to the sump body, and has a plurality of openings extending between its opposite ends.

Other aspects, features and advantages of the present invention will be apparent from the detailed description of the invention that follows.

BRIEF DESCRIPTION OF THE DRAWINGS

For a more complete understanding of the present invention, reference is made to the following detailed description of two exemplary embodiments considered in conjunction with the accompanying drawings, in which.

DETAILED DESCRIPTION OF THE EXEMPLARY EMBODIMENTS

Figure 1:
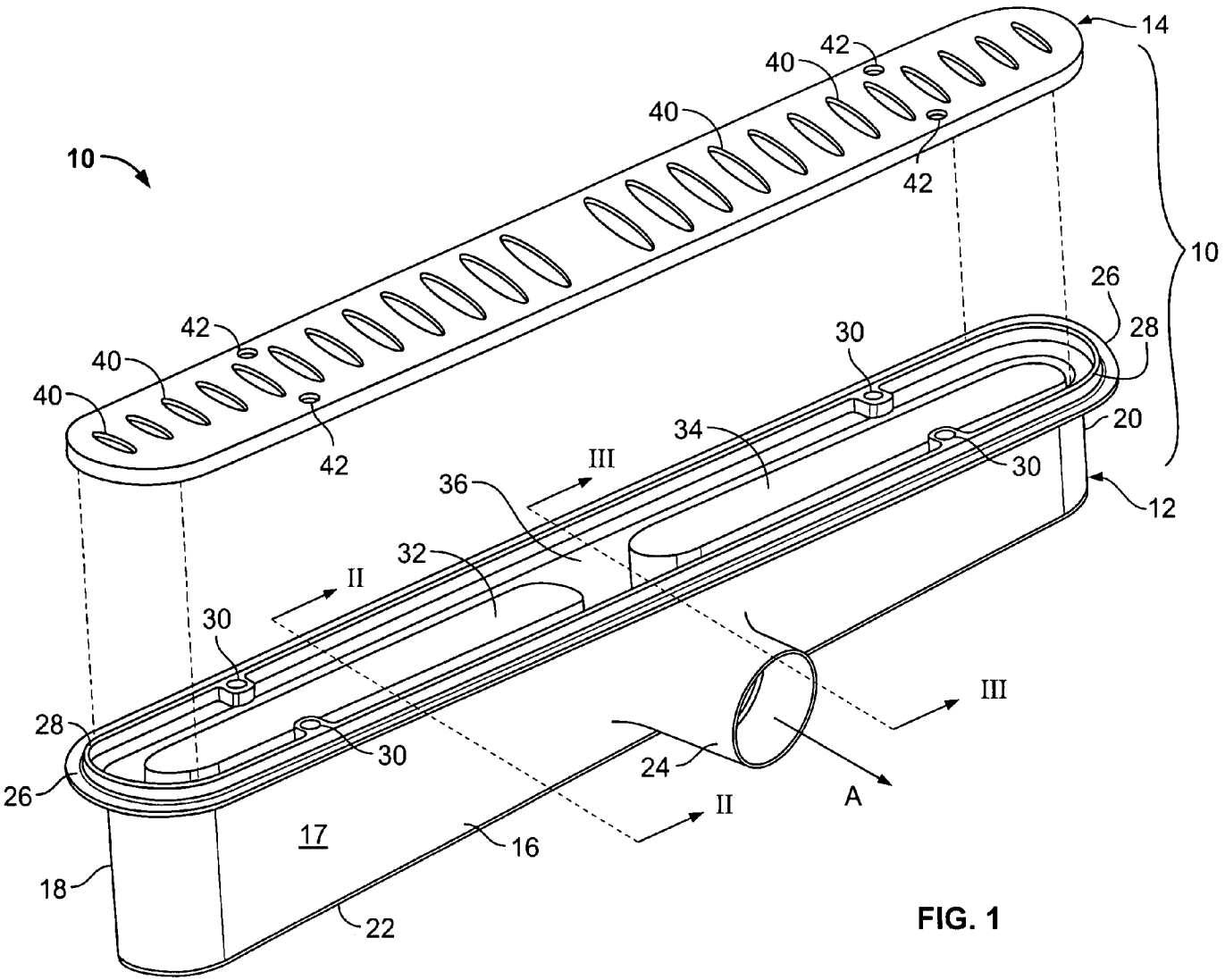
FIG. 1 is an exploded perspective view of an elongated sump and cover constructed in accordance with a first embodiment of the present invention.
Figure 2:
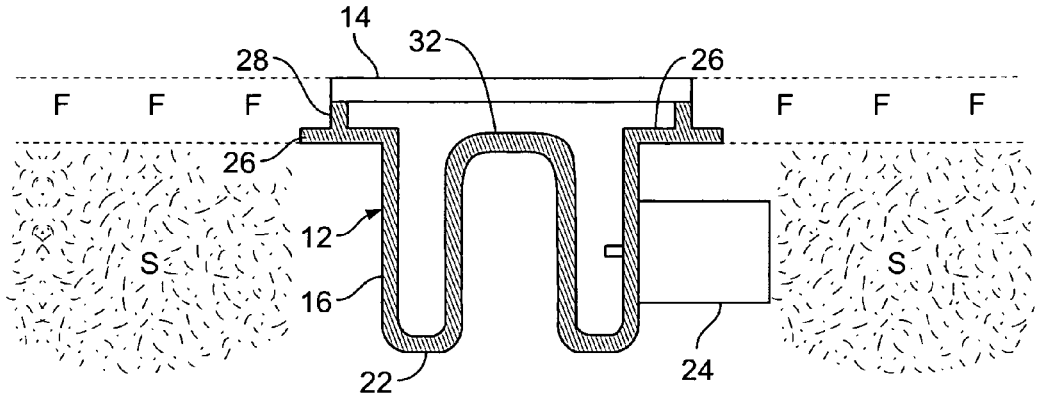
FIG. 2 is a sectional view taken along line II-II in FIG. 1 of the elongated sump and cover shown in FIG. 1
Figure 3:
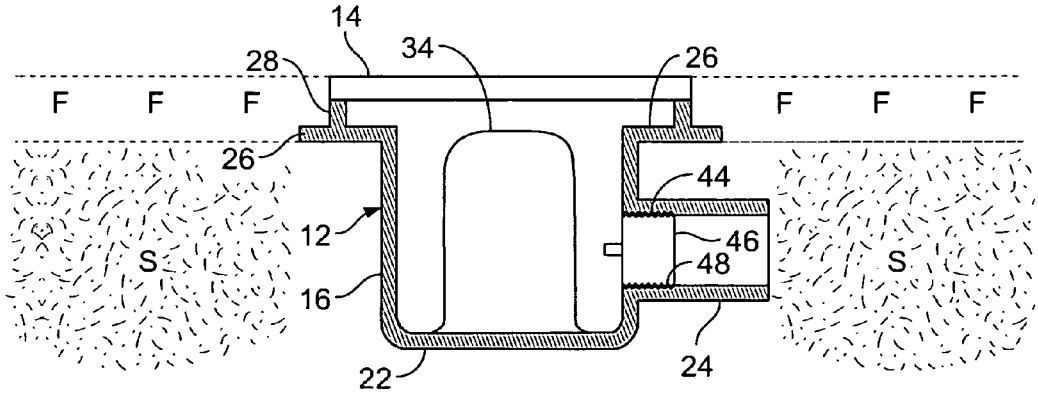
FIG. 3 is a sectional view taken along line III-III in FIG. 1 of the elongated sump and cover shown in FIG. 1

Referring generally to FIGS. 1-5, there is shown an elongated suction outlet 10 having a sump 12 and a cover 14 constructed in accordance with one exemplary embodiment of the present invention. FIGS. 2 and 3 illustrate the suction outlet 10 as installed in the floor F (i.e., the bottom surface) of a swimming pool, which is imbedded in the underlying soil S. The suction outlet 10 may also be installed in the sidewall of the swimming pool (not shown). As shown in FIG. 1, the sump 12 has a trough-like body 16 which is elongated and preferably formed in a generally obround (i.e. straight sides with semi-circular ends) or elliptical shape. The body 16 has an outer wall 17 with opposed rounded ends 18, 20. The ends 18, 20 are substantially equal in height. The body 16 also has a generally obround or elliptical bottom 22 extending between the ends 18, 20, as shown. A sump outlet nozzle 24 is provided in the outer wall 17 (preferably formed integrally with it) at a point intermediate the ends 18, 20. The sump outlet nozzle 24 provides a connection for suction piping that conveys pool water flowing through the cover 14 and the sump 12 to a collector tank, circulation pump, or the like (not shown) in the direction of the arrow A shown in FIG. 1. Water is returned to the pool via return piping (not shown). A second sump outlet nozzle 25 may also be provided in the outer wall 17, as illustrated in phantom lines in FIGS. 4 and 5.

Figure 4:
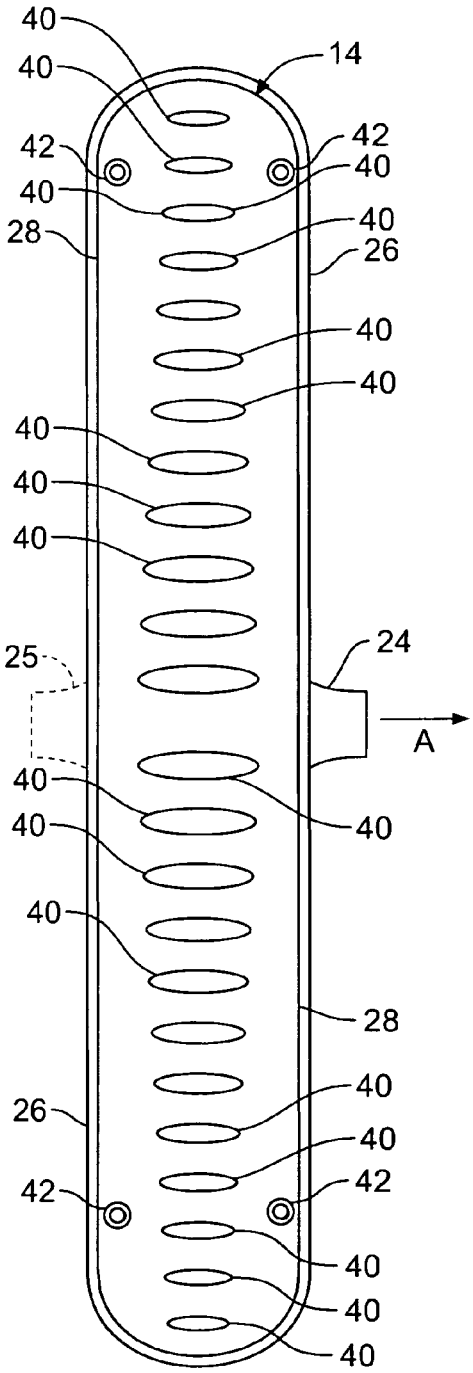
FIG. 4 is a top plan view of the elongated sump and cover shown in FIG. 1.
Figure 5:
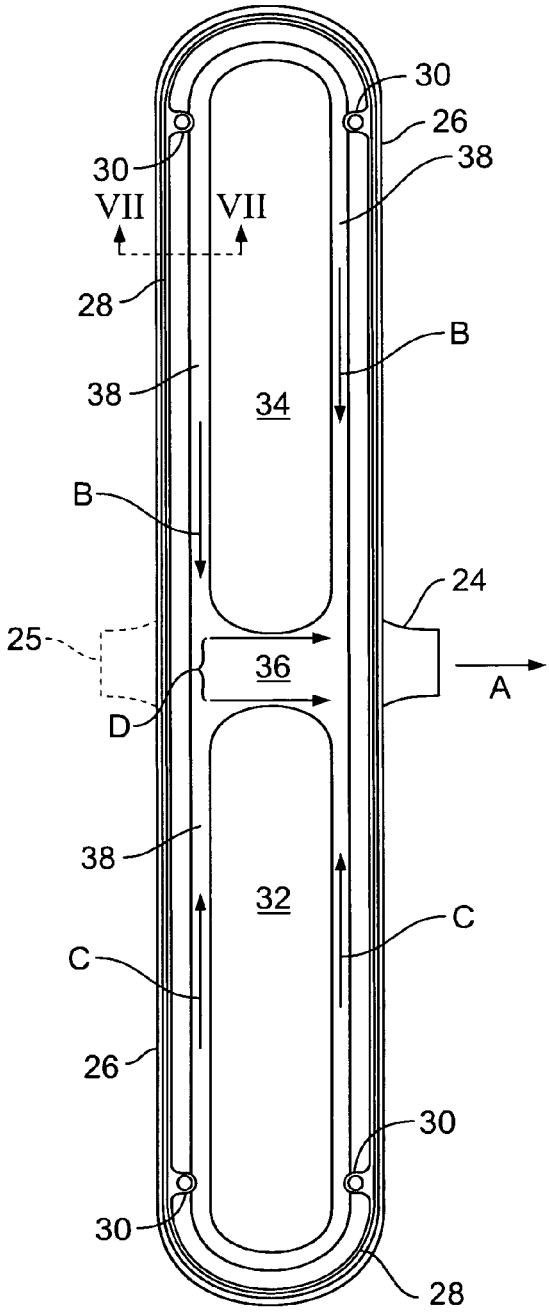
FIG. 5 is a top plan view of the elongated sump shown in FIG. 1 with the cover removed to facilitate consideration and discussion.

With continued reference to FIGS. 1-5, the body 16 has an obround or elliptical flange, or lip 26 which is integrally formed therewith, so as to be distal from and opposite to the bottom 22. The lip 26 extends outwardly from the body 16 so as to be substantially parallel to the pool surface. A circumferential top 28 extends substantially perpendicularly and upwardly from the lip 26, and substantially parallel to the outer wall 17. The top 28 is preferably formed in a generally elliptical shape, so as to have an open configuration, rather than the closed configuration of the bottom 22. A plurality of apertured protrusions 30 is integrally formed with the top 28, each protrusion 30 extending inwardly from the top 28, as shown in FIGS. 1 and 5, and having a hole or other receptacle adapted to receive a fastener, such as a screw or bolt, if desired.

Referring still to FIGS. 1-5, the body 16 further includes two longitudinal, raised islands 32, 34 disposed within the outer wall 17. The islands 32, 34 are preferably integrally formed with the bottom 22, and extend upwardly from the bottom 22 to the approximate vertical level of the top 28, as shown in FIG. 2. The islands 32, 34 may be coaxially arranged within the outer wall 17. Axial flow channels 38 are formed between the islands 32, 34 and the outer wall 17 (see FIG. 5). The outlet nozzle 24 communicates directly with one of the axial flow channels 38. The second outlet nozzle 25, when it is provided, communicates directly with the other axial flow channel. The axial flow channels may converge at the ends 18, 20 of the body 16 so as to form a continuous elliptical path that encircles the islands 32, 34. Alternatively, the islands 32, 34 may engage the respective ends 18, 20 of the wall 17, so as to form peninsulas therewith. As seen in FIG. 5, a center channel 36 is formed between the islands 32, 34 and communicates between the axial channels 38. Both the center channel 36 and the axial channels 38 are narrow relative to the overall width of the sump 12, the significance of which is to be discussed hereinafter.

The cover 14 is preferably formed in a generally obround or elliptical shape, and is dimensioned to engage the top 28 of the sump body 16, as illustrated in FIGS. 1 and 4. In this embodiment, the cover 14 is flat, so as to be planar or substantially parallel to the pool floor and unintrusive to swimmers (and/or bathers in a spa or hot tub), or to pool cleaning devices. The cover 14 is provided with a plurality of openings 40 so that it functions as a grate, providing a continuous surface for bather contact. The openings 40 may be of one size and pattern or of various sizes and patterns. The cover 14 also has holes 42 which correspond in number and placement to the apertured protrusions 30, thereby enabling the cover 14 to be secured to the body 16 by screws passing through the holes 42 and into the apertured protrusions 30.

Referring now to FIG. 3, the outlet nozzle 24 is provided with tapered female threads on its inner surface 44, adjacent the body 16. A pressure test plug 46, with male threading 48, may be received in the outlet nozzle 24 to perform pressure testing, which is required to assure the integrity of the pool water piping system. If a second outlet nozzle 25 is provided, a second pressure test plug (not shown) may be received therein. While the center channel 36 between the islands 32, 34 is narrow, it is wide enough to allow the insertion of a tool for securing the plug 46 into the outlet nozzle 24. Alternatively, a piston or face seal may be provided with a cross bar on its back that would allow insertion with the bar in the vertical position, between the islands 32, 34 (not shown). The bar would be urged against, or into, the outlet nozzle 24 by rotating it into a horizontal position whence the ends of the bar bear against the islands 32, 34 to react test pressure thrust. Only the bar ends are actually involved, and so two protrusions are adequate.

In operation, pool water flows into the suction outlet 10 through the openings 40 in the cover 14. Due to the large surface area of the cover 14 and the openings 40 distributed throughout that surface area, water flows through the openings 40 more uniformly and at a lower velocity than it would through a smaller surface area having fewer openings. The reduced flow velocity through the openings 40 in the cover 14 minimizes the hazard of hair entrapment. Once the water enters the sump 12, it flows through the channels 38 and 36 towards the outlet nozzle 24, as shown by the arrows B, C and D in FIG. 5. The water then flows out of the outlet nozzle 24 in the direction of the arrow A to be recirculated.

Referring again to FIGS. 1 and 4, the cover 14 is elongated, having a preferred length of 32 inches or longer. The length of the cover 14 makes it unlikely, if not impossible, for a bather to block all of the openings 40 with his or her body or body part and thereby create a dangerous entrapping force. The cover 14 is preferably flat, so as not to be overly obtrusive with respect to a pool sidewall or floor, but may be of a crowned (i.e., domed) section where bather contact is unlikely, such as deep water. The crowned configuration may also be preferred in case of heavy vegetative debris, allowing it to accumulate on the perimeter, rather than on the wide surface.

In the event that the cover 14 disengages from the top 28 of the body 16, the islands 32, 34 provide an effective safety back-up system. Referring now to FIGS. 1 and 5, the islands 32, 34 are arranged end to end, so as to create an access-limiting center channel 36, which prevents a bather from accessing the outlet nozzle 24, thereby avoiding limb entrapment. Accordingly, the axial flow channels 38, which are defined by the islands 32, 34 and the outer wall 17, prevent a bather from accessing the outlet nozzle 24 with his or her body or body parts, thereby avoiding entrapment.

Referring again to FIGS. 1-5, the sump 12 preferably has a length of at least 32 inches, which length makes it unlikely, if not impossible, for a bather to block the opening defined by the top 28 with his or her body or limb and thereby create a dangerous entrapping force. Since the upper ends of the islands 32, 34 are coplanar or nearly coplanar with the top 28, the entrapping area is limited to a portion of the area defined by the top 28 less the area defined by the islands 32, 34. This arrangement limits the entrapping force. Since water can still flow through the unblocked portion, the pressure differential between the pool and the sump 12 is safely limited.

It should be appreciated that the present invention provides numerous advantages over the prior art discussed above. For instance, the length of the cover 14 virtually eliminates the possibility that a bather will block the entire area of the cover 14 with his or her body or limb. The openings 40 are also of a size and quantity so as to establish a uniform flow of water into the suction outlet 10, thereby substantially reducing the velocity of the water flow through the openings 40.

The flat configuration of the cover 14 is advantageous in that it may be installed flush with the pool sidewall or floor, and thereby be less intrusive. Furthermore, this feature allows the suction outlet 10 to be installed in conventional pools without the need for extensive customization of the pool. Such customization is necessary for other safety devices, and limits their commercial appeal because pool builders are less inclined to make extensive changes to their design. Moreover, pool owners are less likely to install an unconventionally-shaped device in their pools, especially if the expense and the extensive work involved in installation is prohibitive or deemed excessive, notwithstanding the safety advantages. The present invention provides improved safety features without requiring the purchase, installation and use of unconventionally-shaped devices.

A further important advantage of the sump 12 is the back-up safety feature (i.e., the raised islands 32, 34). By restricting the width of the axial flow channels 38 and the center channel 36, the islands 32, 34 help inhibit human entrapment in the event that the cover 14 becomes disengaged or dislodged. While many devices provide covers or surfaces that aim to eliminate entrapment, these devices do not include a reliable back-up safety feature that anticipates this possibility.

To accommodate such a possibility, some installations have used two or more suction outlets of the prior art. With the safety features of the present invention, only one suction outlet of sufficient flow capacity is needed, affording attendant labor savings and a cleaner visual appearance.

Figure 6:
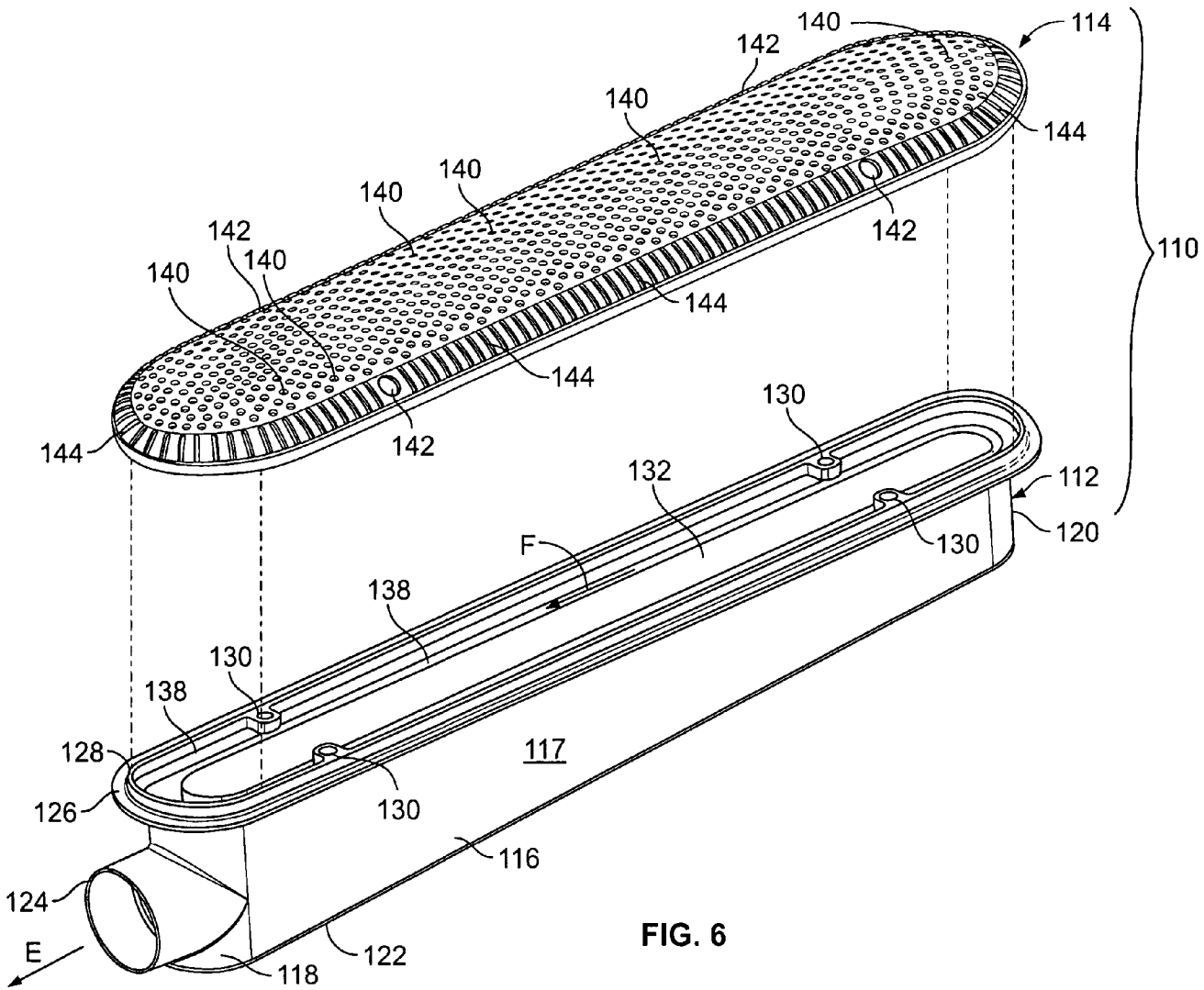
FIG. 6 is an exploded perspective view of a second embodiment of an elongated sump and cover constructed in accordance with the present invention.

A second exemplary embodiment of the present invention is illustrated in FIG. 6. Elements illustrated in FIG. 6 which correspond substantially to the elements described above with reference to FIGS. 1-5 have been designated by corresponding reference numerals increased by one hundred. The embodiment of the present invention shown in FIG. 6 operates and is constructed in manners consistent with the foregoing description of the elongated suction outlet 10 shown in FIGS. 1-5, unless it is stated otherwise.

FIG. 6 illustrates an elongated suction outlet 110 having a sump 112 and a cover 114. The suction outlet 110 is installed in a sidewall or floor (i.e., bottom surface) of a swimming pool (not shown). The sump 112 has a trough-like body 116, which is elongated and preferably formed in a generally obround or elliptical shape. The body 116 has an outer wall 117 with opposed rounded ends 118, 120. The end 118 is longer than (i.e., extends deeper into a pool floor than) the end 120 in this embodiment. The body 116 also has a generally obround or elliptical bottom 122 extending between the ends 118, 120. The bottom 122 is disposed at an angle between the ends 118, 120 in this embodiment, as shown in FIG. 6. A sump outlet nozzle 124 is provided in the outer wall 117 (preferably formed integrally with it) at the end 118. The sump outlet nozzle 124 conveys pool water flowing through the cover 114 and the sump 112 to a collector tank, circulation pump or the like (not shown) in the direction of the arrow E shown in FIG. 6. Water is returned to the pool via return piping (not shown).

With continued reference to FIG. 6, the body 116 has an elliptical flange, or lip 126 which is integrally formed therewith, so as to be distal from and opposite to the bottom 122. The lip 126 extends outwardly from the body 116 so as to be substantially parallel to the pool surface. A circumferential top 128 extends substantially perpendicularly and upwardly from the lip 126, and substantially parallel to the outer wall 117. The top 128 is preferably formed in a generally elliptical shape, so as to have an open configuration, rather than the closed configuration of the bottom 122. A plurality of apertured protrusions 130 is integrally formed with the top 128, each protrusion 130 extending inwardly from the top 128, as shown in FIG. 6, and having a hole or other receptacle adapted to receive a fastener, such as a screw or bolt, if desired.

Referring still to FIG. 6, the body 116 further includes one longitudinal, raised island 132 within the outer wall 117. The island 132 is preferably integrally formed with the bottom 122, and extends upwardly from the bottom 122 to the approximate vertical level of the top 128 (similar to the islands 32, 34 of the first embodiment, as shown in FIG. 2). Axial flow channels 138 are formed between the island 132 and the outer wall 117. The axial flow channels 138 may converge at the ends 118, 120 of the body 116 so as to form a continuous elliptical path that encircles the island 132. The flow channels 138 are narrow relative to the overall width of the sump 112, the significance of which is to be discussed hereinafter The cover 114 is preferably formed in a generally obround or elliptical shape, and is dimensioned to engage the top 128 of the sump body 116, as illustrated in FIG. 6. The cover 114 is of a crowned (i.e., domed) section and defines a plurality of openings 140 that are smaller and more numerous than in the first exemplary embodiment described above. The openings 140 may be of one size and pattern or of various sizes and patterns. The cover 114 also has holes 142 which correspond in number and placement to the apertured protrusions 130, thereby enabling the cover 114 to be secured to the body 116 by screws passing through the holes 142 and into the apertured protrusions 130. The cover 114 also includes apertures 144 disposed about its circumferential edge.

In operation, pool water flows into the suction outlet 110 through the openings 140 in the cover 114. Due to the large surface area of the cover 114 and the openings 140 distributed throughout that surface area, water flows through the openings 140 more uniformly and at a lower velocity than it would through a smaller surface area having fewer openings. The reduced flow velocity through the openings 140 in the cover 114 minimizes the effect associated with hair entrapment. Once the water enters the sump 112, it flows through the channels 138 and towards the outlet nozzle 124, as shown by the arrow F in FIG. 6. The water then flows out of the outlet nozzle 124 in the direction of the arrow E to be recirculated.

Referring again to FIG. 6, the cover 114 is elongated, having a preferred length of at least 32 inches. The length of the cover 114 makes it unlikely, if not impossible, for a bather to block all of the openings 140 and the apertures 144 with his or her body or body part and thereby create an entrapping force.

In the event that the cover 114 disengages from the top 128 of the body 116, the island 132 provides an effective safety back-up system. Still referring to FIG. 6, the island 132 is configured so as prevent a bather from accessing the outlet nozzle 124 with his or her body or limb, thereby avoiding entrapment. In other words, since the upper end of the island 132 is coplanar or nearly coplanar with the top 128, the entrapping area is limited to a portion of the area defined by the top 128, less the area defined by the island 132. This arrangement limits the entrapping force. More particularly, the axial flow channels 138, which are formed between the island 132 and the outer wall 117, prevent a bather from accessing the outlet nozzle 124 with his or her body or body parts, thereby avoiding limb entrapment. Even if a bather's body or body part were to block a portion of one of the axial flow channels 138, water could still flow through the unblocked portion, thereby limiting the pressure differential between the pool and the sump 112 that the blockage creates.

It should be appreciated that this embodiment of the present invention also provides numerous advantages over the prior art discussed above. For instance, the length of the cover 114 virtually eliminates the possibility that a bather can block the entire area of the cover 114 with his or her body or limb. The openings 140 are also of a quantity so as to establish a uniform flow of water into the suction outlet 110, thereby substantially reducing the velocity of the water flow through the openings 140.

A further important advantage of the sump 112 is the back-up safety feature (i.e., the raised island 132). By restricting the width of the axial flow channels 138, the island 132 helps inhibit human entrapment in the event that the cover 114 becomes disengaged or dislodged. While many devices provide covers or surfaces that aim to eliminate entrapment, these devices do not include a reliable back-up safety feature that anticipates this possibility.

It should be understood that the embodiments of FIGS. 1-6 are merely exemplary, and that a person skilled in the art may make many variations and modifications without departing from the spirit and scope of the invention. For instance, a flow channel and inter-island space can be provided to create a fluidic oscillator. With respect to the single island embodiment, a bay may be provided for allowing access to the test plug. These features could cause unstable flow, which can encourage scouring of fine debris that might otherwise collect. Furthermore, as noted above, two or more outlet nozzles may be provided to service multiple pumps. In some soil types, it may be preferred to fill the volume below the islands 32, 34, 132 with concrete at the jobsite, or with foam in the factory. In addition, a hydrostatic relief valve may be provided in the sump. This allows rising ground water level to enter an empty pool to prevent flotation of the pool structure.

Figure 7:
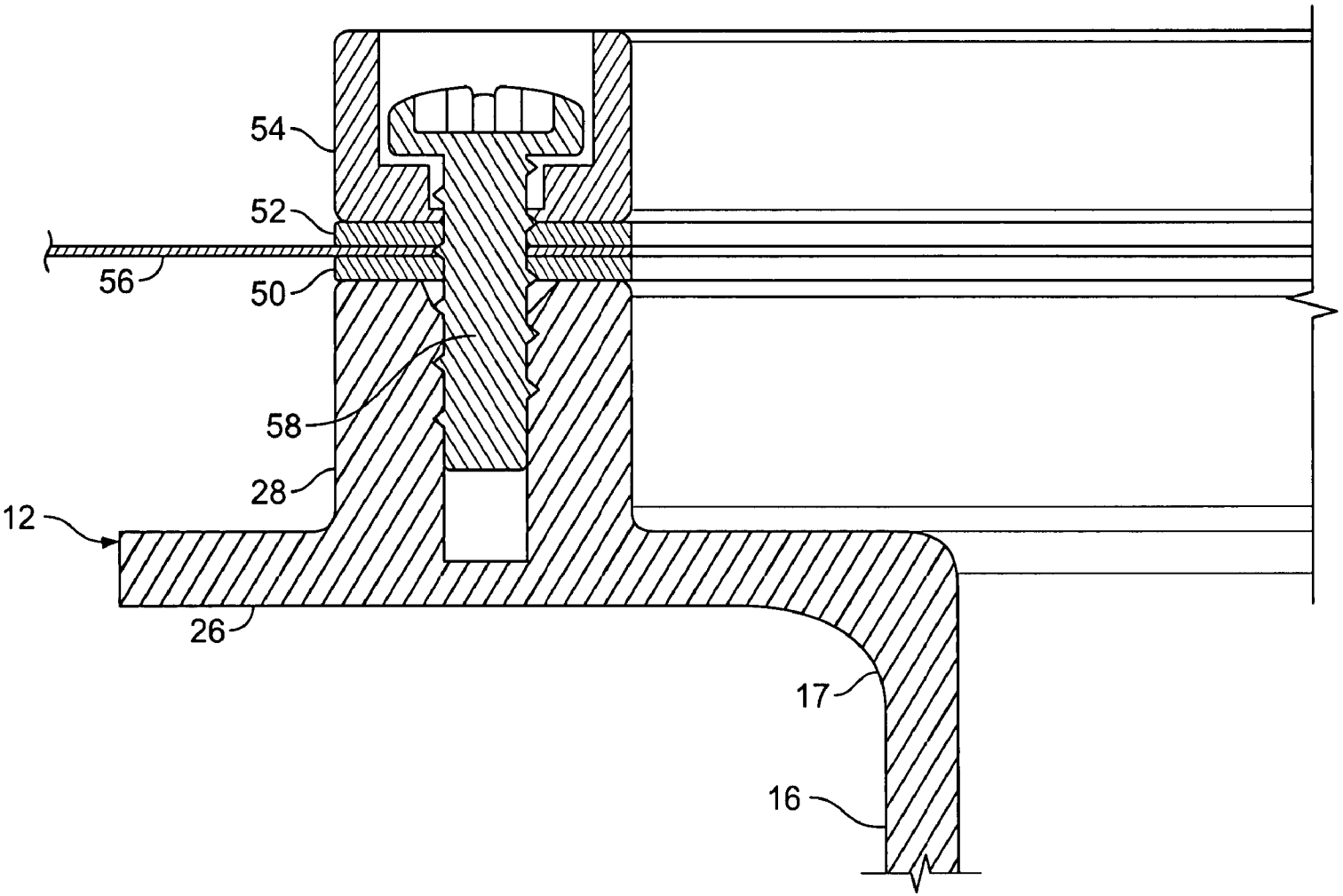
FIG. 7 is an enlarged, partial sectional view taken along line VII-VII in FIG. 5 of the uncovered elongated sump shown in FIG. 5 with a sealing system for a vinyl-lined pool.

Referring now to FIG. 7, two annular compliant gaskets 50, 52 and a rigid plastic sealing ring 54 may be provided for use in the installation of the sump of either of the exemplary embodiments (or other embodiments of the present invention) in a vinyl-lined swimming pool. For illustrative purposes, the annular gaskets 50, 52 and the sealing ring 54 are shown incorporated in the sump 12 of the first exemplary embodiment of FIGS. 1-5, and more particularly, at a location on the top 28 of the sump body 16 in FIG. 5 (the section lines VII-VII are shown in FIG. 5, but the annular gaskets 50, 52, pool liner 56 and sealing ring 54 are only shown in FIG. 7) During installation, a first annular gasket 50 is placed on the top 28 of the sump body 16. The vinyl liner 56 of the pool is then laid over the first gasket 50 and the sump 12. A second annular gasket 52 is then laid over the vinyl liner 56 so as to be aligned with the first annular gasket 50. The sealing ring 54 is secured with fasteners 58 (only one fastener 58 is shown in FIG. 7) which pass through the annular gaskets 50, 52 and the vinyl liner 56, and are mechanically secured to the top 28. This arrangement sandwiches the vinyl liner 56 between the annular gaskets 50, 52, thereby protecting the vinyl liner 56 from being cut or damaged during installation and use. The sealing ring 54 simultaneously presses the annular gaskets 50, 52 and vinyl liner 56 against the top 28, and blocks the leakage of pool water into the soil below the sump 12. The vinyl liner 56 is cut with a knife at the inner edge to expose the sump 12.

Enhanced protection against hair entrapment may also be provided by eliminating fasteners from the suction outlet assembly 10/110 of either of the exemplary embodiments (or other embodiments of the present invention). More particularly, the sump 12/112 may be provided with a contoured lip having an angle between approximately 5° and 85° (for example, an angle of approximately 30°), and the cover 14/114 may be provided with a matching contoured skirt, so that the cover 14/114 may lay in place. The slope of the contoured skirt of the cover 14/114 facilitates release, even if the slot were packed with dirt. In accordance with this modification, no finger hold is provided to encourage lift-out, but if an unforeseeable incidence of hair entrapment were to occur, a bather could use his or her hair itself to pull the cover 14/114 off of the sump 12.

All such variations and modifications are intended to be included within the scope of the invention as set forth in the appended claims.

We claim:

1. A suction outlet assembly, comprising:

a sump having an elongated, trough-like body, said body including an outer wall with opposed ends, a bottom extending between said opposed ends, an open top opposite said bottom, and at least one island extending upwardly from said bottom, said at least one island being spaced from said outer wall so as to form a first axial flow channel on one side of said sump and a second axial flow channel on an opposite side of said sump, each of said first and second axial flow channels having a width selected so as to inhibit the insertion of human body parts therein; and an elongated cover removably attached to said body adjacent said top thereof, said cover having a plurality of openings extending between opposite ends of said cover.

2. The suction outlet assembly of claim 1, wherein said at least one island includes first and second islands.

3. The suction outlet assembly of claim 2, wherein said first and second islands are substantially coaxially disposed, said first island being spaced from said second island so as to form a center channel having a width selected so as to inhibit the insertion of human body parts therein, and said center channel being in communication with said axial channels.

4. The suction outlet assembly of claim 2, wherein an end of said first island distal from said second island engages one of said opposed ends of said outer wall so as to form a first peninsula, and an end of said second island distal from said first island engages the other one of said opposed ends of said outer wall so as to form a second peninsula.

5. The suction outlet assembly of claim 1, wherein said body has a length and a width, said body being elongated such that said length is substantially greater than said width.

6. The suction outlet assembly of claim 5, wherein said body is of sufficient length to preclude blockage by a single bather.

7. The suction outlet assembly of claim 1, wherein said cover includes first and second portions, said cover being dimensioned such that when said first portion is covered by a bather's body part, said second portion remains uncovered.

8. The suction outlet assembly of claim 7, wherein said cover is at least 32 inches long.

9. The suction outlet assembly of claim 1, wherein said at least one island extends upwardly from said bottom and terminates at an upper end which is substantially coplanar with said top of said body.

10. The suction outlet assembly of claim 1, wherein said at least one island is formed integrally with said bottom.

11. The suction outlet assembly of claim 1, wherein said openings in said cover are of a size, quantity and spacing selected so as to establish a uniform flow of water therethough to substantially reduce the velocity of water flow.

12. The suction outlet assembly of claim 1, wherein said sump further includes at least one outlet nozzle, said at least one outlet nozzle being in communication with at least one of said first and second axial flow channels.

13. The suction outlet assembly of claim 12, wherein said at least one outlet nozzle includes a first outlet nozzle being in communication with said first axial flow channel and a second outlet nozzle being in communication with said second axial flow channel.

14. The suction outlet assembly of claim 12, said at least one outlet nozzle being disposed at one of said opposed ends.

15. The suction outlet assembly of claim 14, wherein said one of said opposed ends is deeper than the other one of said opposed ends.

16. The suction outlet assembly of claim 1, wherein said cover is substantially flat.

17. The suction outlet assembly of claim 1, wherein said cover is substantially crowned.

18. The suction outlet assembly of claim 1, further comprising a protective assembly for use with a vinyl pool liner, said protective assembly having at least one annular gasket positioned on the pool liner, a sealing ring engaged with said at least one annular gasket opposite said pool liner, and a fastener securing said sealing ring, said at least one gasket and the pool liner to said top.

* * * * *